United States Patent [19]

Eck

[11] Patent Number: 5,058,543

[45] Date of Patent: Oct. 22, 1991

[54] ELECTRONIC IGNITION MODULE

[75] Inventor: Gary Eck, Otwell, Ind.

[73] Assignee: Sten's Lawnmower Parts, Inc., Jasper, Ind.

[21] Appl. No.: 602,130

[22] Filed: Oct. 23, 1990

[51] Int. Cl.[5] ..... F02P 1/08

[52] U.S. Cl. ..... 123/149 C; 123/418; 123/618

[58] Field of Search ..... 123/149 C, 418, 618, 123/149 R, 149 A; 315/218

[56] References Cited

U.S. PATENT DOCUMENTS

| | | | |
|---|---|---|---|
| 4,175,509 | 11/1979 | Orova et al. | 123/149 C |
| 4,188,929 | 2/1980 | Podrapsky et al. | 123/149 C |
| 4,207,852 | 6/1980 | Ohki et al. | 123/149 C |
| 4,817,577 | 4/1989 | Dykstra | 123/149 C |

FOREIGN PATENT DOCUMENTS

| | | | |
|---|---|---|---|
| 58-15761 | 1/1983 | Japan | 123/149 C |
| 58-15762 | 1/1983 | Japan | 123/149 C |

*Primary Examiner*—Andrew M. Dolinar

*Attorney, Agent, or Firm*—McAndrews, Held & Malloy, Ltd.

[57] ABSTRACT

An electronic ignition module for an internal-combustion engine that is supplied with sparking energy from a rotating magnet includes a switchable semiconductor device through which current in the primary of an ignition coil is to be conducted. A portion of a circuit in the module senses a time when voltage across the semiconductor device approaches a maximum value, and produces a signal at that time that switches the semiconductor device out of conduction. A positive-feedback circuit is connected to increase the switching speed of the semiconductor device. The semiconductor device is protected against AC voltages of a polarity opposite to that of the conducting direction of the semiconductor device, and is caused to advance switching time in response to increased voltages associated with high engine speed. A temperature-sensitive resistor performs temperature compensation on the module in response to the temperature of a hot engine to permit restart of the engine if it is stopped briefly.

14 Claims, 1 Drawing Sheet

ELECTRONIC IGNITION MODULE

BACKGROUND OF THE INVENTION

This invention is related to ignition modules for internal combustion engines. In particular, it is an electronic module that creates a timed open circuit to generate the high voltage necessary to fire spark plugs in gasoline engines for lawn mowers, chain saws and the like that have magneto ignition systems and do not have batteries to supply the energy for ignition.

The production of a voltage of the order of kilovolts that is necessary to jump the gap in a spark plug is typically effected by the use of an induction coil in which a relatively high current in a primary winding is interrupted, producing a relatively high L di/dt voltage. This voltage is stepped up by transformer action in the induction coil to produce the sparking voltage. In small engines that do not have batteries, it is common to obtain the current that is interrupted by induction from a permanent magnet that is rotated in synchronism with the engine. This is often referred to as a magneto ignition. Rotation of the permanent magnet so as to couple magnetic flux to the coil typically produces a negative-going voltage and a positive-going voltage, one of which is shorted out to permit the buildup of current in a desired direction in the coil. This current is then interrupted to produce the spark.

The availability of semiconductor devices capable of handling currents at the levels needed by ignition coils has caused increasing use of such semiconductors to replace mechanical breaker points. In the simplest kind of such an electronic module a semiconductor device is placed in series with the current in the coil and is caused to go out of conduction when that current is at or near a maximum value. When the semiconductor device becomes an open circuit, it must be able to withstand the voltage produced by the inductive impulse. The semiconductor device and the other components of the circuit must also withstand whatever reverse voltage is applied to them during the negative half cycle of the voltage developed from the magneto. The semiconductor device and the rest of the module must operate over a range of speeds that is typically at least five or six to one, and may be more. The semiconductor device must carry enough current to develop an adequate spark at the lowest running speed of the engine, and it must handle the higher voltages and associated higher currents produced at the top speed of the engine. The voltage produced by the pickup is typically roughly proportional to engine speed over a considerable range of speeds. It is also desirable in many cases to be able to change the timing of the spark with respect to top dead center (TDC) of the piston. While the engines used in lawn mowers are most often one-cylinder four-cycle engines and those used in chain saws, string trimmers and the like are most often one-cylinder two-cycle engines, the principles discussed here also apply to either type of engine having more than one cylinder.

SUMMARY OF THE INVENTION

It is an object of the present invention to provide a better electronic module for an internal-combustion engine in which a magneto supplies energy for a spark.

It is a further object of the present invention to provide an ignition module for an internal-combustion engine having a magneto to supply energy for ignition in which the ignition module switches a semiconductor device out of conduction to interrupt an electrical current.

It is a further object of the present invention to provide an ignition module for a magneto-operated internal-combustion engine that operates at a wide range of speeds.

It is a further object of the present invention to provide an electronic ignition module for a small engine in which the operation is compensated for in response to higher temperatures of the module to permit a hot engine to be restarted easily.

Other objects will become apparent in the course of a detailed description of the invention.

An electronic ignition module for an internal-combustion engine that is supplied with sparking energy from a rotating magnet includes a switchable semiconductor device through which current in the primary of an ignition coil is to be conducted. A portion of a circuit in the module senses a time when voltage across the semiconductor device approaches a maximum value, and produces a signal at that time that switches the semiconductor device out of conduction. A positive-feedback circuit is connected to increase the switching speed of the semiconductor device. The semiconductor device is protected against AC voltages of a polarity opposite to that of the conducting direction of the semiconductor device, and is caused to advance switching time in response to increased voltages associated with high engine speed. A temperature-sensitive resistor performs temperature compensation on the module in response to the temperature of a hot engine to permit restart of the engine if it is stopped briefly.

BRIEF DESCRIPTION OF THE DRAWING

The Figure is a circuit diagram of an electronic module for the practice of the present invention.

DETAILED DESCRIPTION OF THE INVENTION

Figure 1:
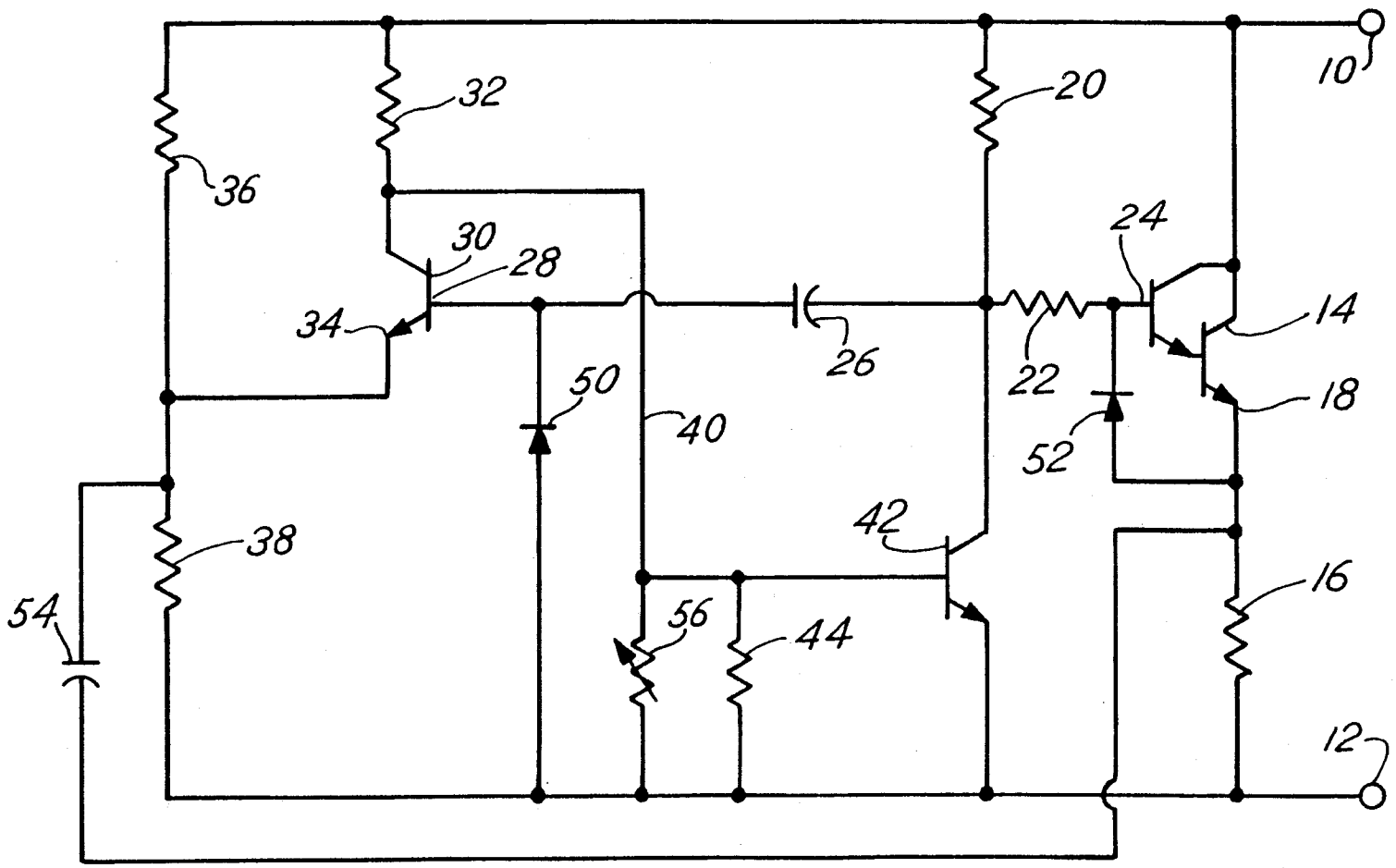

The Figure is a circuit diagram of an electronic ignition module for the practice of the present invention. In the Figure, a first terminal 10 and a second terminal 12 are points of connection for the circuit of the Figure to the ignition coil of a magneto ignition system. The coil and magneto are well known and are not shown here. A Darlington transistor pair 14 is connected to first terminal 10 and to a resistor 16 at emitter 18. While a Darlington transistor pair is shown here as the semiconductor switching device, it should be understood that switching could also be effected by a power field-effect transistor or a bipolar transistor capable of carrying the appropriate current.

The resistor 16 is also connected to the second terminal 12. The function of the resistor 16 is to serve as a dropping resistor to raise the value of voltage between the terminals 10.and 12 by the amount of IR drop produced by the flow of current through the Darlington transistor pair 14. This produces adequate operating voltages for transistors in the circuit at lower values of current. When the magneto produces a voltage that makes the first terminal 10 positive with respect to the second terminal 12, the Darlington transistor pair 14 functions as a switchable semiconductor device and conducts, passing essentially all of the current that flows through the ignition coil through the terminal 10, the Darlington transistor pair 14, the resistor 16 and the second terminal 12. It will be seen later that the Darlington transistor pair 14 will be switched out of conduction at or near the peak value of the voltage applied between the terminals 10 and 12.

A resistor 20 is connected to the terminal 10 and to a resistor 22, which in turn is connected to base 24 of the Darlington transistor pair 14. The combination of the resistors 20 and 22 supplies a base current to the Darlington transistor pair 14 that will cause it to conduct as the voltage from the terminal 10 to the terminal 12 begins to rise from a zero value. A capacitor 26 is connected from the resistors 20 and 22 to the base 28 of a transistor 30. Collector current for the transistor 30 is supplied from the terminal 10 through a resistor 32, and the emitter 34 of the transistor 30 is connected to a voltage divided on the voltage across the terminals 10 and 12 that is formed by two resistors 36 and 38. The values of the components are selected so that the transistor 30 will be caused to conduct in response to base current through the capacitor 26 as the terminal 10 begins to go positive with respect to terminal 12. This causes an increase in voltage drop across the resistor 32, which is connected by a line 40 to a transistor 42, causing the transistor 42 to become essentially an open circuit. A line 40 is connected to the second terminal 12 through a resistor 44.

When the positive voltage between the terminals 10 and 12 reaches a maximum, current through the capacitor 26 goes to zero. The transistor 30 goes out of conduction, causing the transistor 42 to conduct. The voltage at the common point of the resistors 20 and 22 becomes essentially that of the second terminal 12, and the Darlington transistor pair 14 is switched rapidly out of conduction. The speed of the switching in increased by the fact that the common point of the resistors 20 and 22 is also coupled through the capacitor 26 to the base 28 of the transistor 30, constituting positive feedback to the base 28. Current in the first terminal 10 and hence in the ignition coil to which it is connected is reduced essentially to zero by switching the Darlington transistor pair 14 out of conduction, producing a voltage across the coil that is taken to fire a spark plug. Most of the L di/dt voltage produced by interrupting current in the ignition coil will appear between the terminals 10 and 12. However, conduction of the transistor 42 prevents that voltage increase from being coupled through the capacitor 26 to cause the transistor 30 to conduct again until the circuit is ready to reset by passing the terminal voltage through zero.

When the Darlington transistor pair 14 is opened, a voltage typically of the order of 150 volts appears between the terminals 10 and 12. The transistor 42 is protected from the effects of this voltage because the transistor 42 is conducting, and its collector resistance will be small enough that most of the terminal voltage will be dropped across resistor 20. The collector voltage of the transistor 30 is determined by the base voltage of the transistor 42, which is close to the voltage at terminal 12. The emitter voltage of the transistor 30 will be determined by the ratio of the resistors 36 and 38, typically setting a voltage greater than the voltage on the collector of the transistor 30, and so the transistor 30 will also be protected against over-voltage. This protection extends to the diodes 50 and 52.

The resistors 32 and 44 constitute a voltage divider that determines the voltage on the line 40 when the transistor 30 is not conducting. This voltage divider insures that the transistor 30 conducts and the transistor 42 does not conduct at the beginning of a cycle of positive voltage.

The resistors 36 and 38 also form a voltage divider that sets the voltage at the emitter 34 of the transistor 30. The resistor 38 is typically chosen to be smaller than the resistor 36, often by a factor of 10 or more. This insures control of the transistor 42 by the transistor 30. Lower terminal voltage is associated with lower engine speeds. As engine speed increases, the voltage on line 40 will increase, eventually triggering the transistor 42 even before the voltage between the terminals 10 and 12 has reached its maximum.

The rotating magnet in an ignition system of the type described above produces a negative-going voltage at a time in the cycle that is different from the time of the positive-going voltage. A diode 50 clamps the base 28 of the transistor 30 to the voltage at the second terminal 12 when the second terminal 12 is positive with respect to the terminal 10 to keep the voltage across the capacitor 26 from going negative during the negative portion of the terminal voltage. A diode 52 clamps the base 24 of the Darlington transistor pair 14 to its emitter 18, which prevents zener or avalanche breakdown of the Darlington transistor pair 14 on the application of negative voltages. This reduces heating of the module. A capacitor 54 is connected from the emitter 34 from the transistor 30 to the emitter 18 of the Darlington transistor pair 14. The capacitor 54 is a decoupling capacitor that bypasses an inductive impulse that may result from decay of negative-going current in an induction coil.

The circuit of the Figure has been built and tested by printing the circuit using thick-film technology on a ceramic substrate and using surface-mounted components on the substrate. When the circuit was operated using components selected for running a cold engine, occasional difficulty was experienced in restarting a hot engine, because the module was typically mounted in thermal contact with the engine so that the transistors 30 and 42 became hot as the engine heated up. This advanced the timing, which improves running but hampers starting. This difficulty was overcome by installing a temperature-sensitive resistor 56 in parallel with the resistor 44, so that the module including the resistor 56 was heated by the hot engine. Values of the components were chosen so that the temperature-sensitive resistor 56 had a value of resistance that was high in comparison with the resistance of the resistor 44, and therefore the value of the resistor 44 dominated in a cold circuit. When the resistor 56 was warmed by heat from a warm engine, its resistance was less than the resistance of resistor 44. This provided optimum timing to start a hot engine.

A circuit embodying the Figure has been built and tested using the values given in the Table. The circuit was observed to keep spark advance constant to within a few degrees over the entire range of engine speeds whether the engine was hot or cold.

TABLE

Values of Components of the Figure

| Resistors ohms | Capacitors microfarads | Semiconductors |
|---|---|---|
| 16 0.235 | 26. 0.047 | 14 power Darlington pair |
| 20. 270 | 54. 0.047 | 30 small-signal NPN |
| 22. 270 | | 42 small-signal NPN |
| 32 2.2k | | 50 small-signal diode |
| 36 5.6K | | 52 medium-power diode |
| 38 510 | | |
| 44 2.2K | | |

TABLE-continued

| Values of Components of the Figure | | |
|---|---|---|
| Resistors ohms | Capacitors microfarads | Semiconductors |
| 56 1.36K at 100° C.; 20K at 25° C. | | |

The values of components in the Table have been used in a circuit that was built for the practice of the invention with a given ignition coil and a given magnetic pickup system. Different ignition coils or different pickup systems might require different currents and produce different voltages that would require components of different values that could readily be determined by the circuit designer without excessive or undue experimentation. It is to be understood, however, that the values given are exemplary and illustrative and should not be taken as limiting the scope of the invention, which is defined by the claims that follow.

I claim:

1. An electronic ignition module for an internal-combustion engine having a magneto ignition, the module applying to a pair of terminals a short circuit at a time determined by the voltage across the terminals, the module comprising:

(a) a switchable semiconductor device connected between the two terminals to establish and remove the short circuit;

(b) a maximum-sensing first transistor connected to the terminals and to the switchable semiconductor device to sense a maximum value of the voltage across the terminals and produce a signal causing a switch of the switchable semiconductor device to an open circuit, the first transistor switched on by a rising voltage and switched off by a constant voltage, the first transistor coupled by a second transistor to the switchable semiconductor device to switch the switchable semiconductor device out of conduction, the second transistor further connected to the first transistor to supply positive feedback when the first transistor is switched off; and (c) a voltage-sensitive circuit connected to the terminals and to the maximum-sensing circuit and responsive to the voltage across the terminals to advance a time at which the maximum-sensing circuit produces the signal at higher engine speeds.

2. The electronic ignition module of claim 1 comprising in addition a dropping resistor in series with the switchable semiconductor device to develop a voltage to operate the maximum-sensing circuit and the speed-advance circuit.

3. The electronic ignition module of claim 1 wherein the voltage-sensitive circuit comprises a voltage divider connected between the terminals to produce a voltage that is a predetermined portion of the voltage across the terminals.

4. The electronic ignition module of claim 3 comprising in addition a temperature-sensitive resistor connected to a base of the second transistor to vary a time at which the switchable semiconductor is switched out of conduction.

5. The electronic ignition module of claim 3 comprising in addition a dropping resistor in series with the switchable semiconductor device to develop a voltage to operate the maximum-sensing circuit and the voltage-sensitive circuit.

6. The electronic ignition module of claim 1 comprising in addition a clamping diode to prevent operation of the maximum-sensing circuit in response to a voltage having a polarity opposite to a polarity sensed by the maximum-sensing circuit.

7. The electronic ignition module of claim 1 comprising in addition a voltage divider connected between the first terminal and the second terminal and providing a divided voltage that is coupled to the switchable semiconductor device to cause the switchable semiconductor device to conduct at a time that is a function of the voltage between the first terminal and the second terminal.

8. An electronic ignition module for an internal-combustion engine having a magneto ignition, the module applying to a pair of terminals a short circuit at a time determined by the voltage across the terminals, the module comprising:

(a) a Darlington transistor pair connected between the two terminals to establish and remove the short circuit;

(b) a maximum-sensing first transistor connected to the terminals and to the Darlington transistor pair to sense a maximum value of the voltage across the terminals and produce a signal causing a switch of the Darlington transistor pair to an open circuit, the first transistor switched on by a rising voltage and switched off by a constant voltage, the first transistor coupled by a second transistor to the Darlington transistor pair to switch the Darlington transistor pair out of conduction, the second transistor further connected to the first transistor to supply positive feedback when the first transistor is switched off; and (c) a voltage-sensitive circuit connected to the terminals and to the maximum-sensing circuit and responsive to the voltage across the terminals to advance a time at which the maximum-sensing circuit produces the signal at higher engine speeds.

9. The electronic ignition module of claim 8 comprising in addition a voltage divider connected between the first terminal and the second terminal and providing a divided voltage that is coupled to the Darlington transistor pair to cause the Darlington transistor pair to conduct at a time that is a function of the voltage between the first terminal and the second terminal.

10. The electronic ignition module of claim 8 comprising in addition a dropping resistor in series with the Darlington transistor pair to develop a voltage to operate the maximum-sensing circuit and the speed-advance circuit.

11. The electronic ignition module of claim 8 wherein the voltage-sensitive circuit comprises a voltage divider connected between the terminals to produce a voltage that is a predetermined portion of the voltage across the terminals.

12. The electronic ignition module of claim 11 comprising in addition a temperature-sensitive resistor connected to a base of the second transistor to vary a time at which the switchable semiconductor is switched out of conduction.

13. The electronic ignition module of claim 11 comprising in addition a dropping resistor in series with the switchable semiconductor device to develop a voltage to operate the maximum-sensing circuit and the voltage-sensitive circuit.

14. The electronic ignition module of claim 8 comprising in addition a clamping diode to prevent operation of the maximum-sensing circuit in response to a voltage having a polarity opposite to a polarity sensed by the maximum-sensing circuit.

* * * * *